US008453588B2

(12) United States Patent
Kjersem et al.

(10) Patent No.: US 8,453,588 B2
(45) Date of Patent: Jun. 4, 2013

(54) FLOAT STRUCTURE FOR STORING LIQUIDS

(75) Inventors: Geir Lasse Kjersem, Bønes (NO); Torbjørn Bringedal, Kalandseidet (NO)

(73) Assignee: Luno, Mehr & Glever-Enger Marin AS, Bergen (NO)

( * ) Notice: Subject to any disclaimer, the term of this patent is extended or adjusted under 35 U.S.C. 154(b) by 46 days.

(21) Appl. No.: 12/932,208

(22) Filed: Feb. 18, 2011

(65) Prior Publication Data

US 2011/0209655 A1 Sep. 1, 2011

(30) Foreign Application Priority Data

Feb. 18, 2010 (NO) ..... 20100252

(51) Int. Cl.
*B63B 39/03* (2006.01)
*B63B 35/44* (2006.01)

(52) U.S. Cl.
USPC ..... 114/125; 114/265

(58) Field of Classification Search
USPC ..... 114/125, 264, 265
See application file for complete search history.

(56) References Cited

U.S. PATENT DOCUMENTS

| | | | | | |
|---|---|---|---|---|---|
| 3,412,564 | A * | 11/1968 | McClintock | ..... | 405/208 |
| 3,771,481 | A * | 11/1973 | Goren et al. | ..... | 114/265 |
| 4,314,776 | A * | 2/1982 | Palmer et al. | ..... | 405/205 |
| 4,576,518 | A * | 3/1986 | Cooke et al. | ..... | 405/205 |
| 4,646,672 | A * | 3/1987 | Bennett et al. | ..... | 114/264 |
| 4,646,762 | A | 3/1987 | Bennett | | |
| 5,292,207 | A * | 3/1994 | Scott | ..... | 405/207 |
| 2009/0126616 | A1 * | 5/2009 | Srinivasan | ..... | 114/264 |

* cited by examiner

*Primary Examiner* — Stephen Avila
(74) *Attorney, Agent, or Firm* — Francis C. Hand; Carella, Byrne, et al

(57) ABSTRACT

The float structure is constructed with a bottom structure providing buoyancy to the float structure, an upper deck and a number of support columns that connect the bottom structure and the equipment deck which is to be positioned above the surface of the water in which the float is arranged to operate. The float structure is characterized in that at least one of said support columns comprises a liquid storage column which is placed in the middle section of the float structure with the remaining support columns are positioned in the outer sections of the float structure. Active ballast tanks are disposed in the middle section of the bottom structure adjacent the liquid storage column and secondary ballast tanks are disposed in the outer part of the bottom structure.

14 Claims, 2 Drawing Sheets

FLOAT STRUCTURE FOR STORING LIQUIDS

This invention relates to a float structure for storing liquids, particularly hydrocarbons. More particularly, this invention relates to a float structure for the temporary storing of oil at sea.

THE STATE OF ART

Semisubs which are built according to known methods have a wide application in the offshore industry, both in the exploration of, and in the production of, oil. They are used as oil rigs or as anchored production floats in many parts of the world. However, these semisubs are not suitable for the storage of produced oil.

Another disadvantage with semisubs is that the damage stability is often very poor if any damage occurs to one of the support columns, for example, as a consequence of a collision. In particular, damage to the corner columns can have catastrophic consequences, including the complete wrecking of the unit.

Compared to known half-submersible rigs, production ships have one advantage in that the production ships can store oil. However, in exposed ocean areas, a production ship must be fitted with an expensive turret so that the ship can rotate with the weather to reduce the environmental forces on the ship.

A production ship with a turret provides advantages in the normal production of oil and gas, but is often less suited to production of more problematic oils, such as heavy oil or wax-containing oils because of an often high number of risers and control cables that have to run through the turret.

Production ships with a turret are also less suited for operation at water depths greater than 1500 meters because production ships with a turret function best in combination with traditional, flexible, composite production pipes. These composite pipes consist largely of spun steel and plastic materials which today are limited to operations down to depths of about 1500 meters.

Production ships with the use of a turret are not suitable in cases where one wishes to use flexible steel pipes between the wells at the ocean bed and the float, such as at very high gas and fluid pressures, possibly in combination with high temperatures and content of $CO_2$ or $H_2S$.

Also known are production floats that have a cylindrical shape to eliminate the need to rotate with the wind. The disadvantage with these floats is that they will require large building docks with large diameters, at the same time as the process systems on deck must be built so as to be integrated into the deck, which often leads to longer building time and is more expensive than the building of deck structures that are based on modules, such as traditional production ships with long, rectangular deck areas reserved for modules.

Weather statistics over many years provide the dominant and most likely direction for ocean environmental forces. During anchoring of ships in many areas, the largest waves will come, for example, from specific sectors in the open sea, while waves due to land breezes are statistically very small.

At an anchorage location there are several factors in addition to just the direction of the wind that can influence the direction and the height of the waves. The formation of the coastline can contribute to turn waves or sea swells in a specific direction. For example, a south-westerly storm in the Atlantic west of Ireland will set up waves from the south-west. These waves can thereafter turn as large ocean swells into the North Sea in a more south-easterly or southerly directions when they pass the northern tip of Scotland, i.e. between Scotland and Shetland Islands. If, in addition, a new storm arises in this area, this will reinforce the height of the waves.

In such situations, the so-called 100-year wave can arise. Weather statistics can indicate in which sectors this wave will, in all probability, come from. In this case, an extreme wave in the North Sea will most likely come from a sector of about 45° from the north/north-west. The probability that such an extreme wave shall come from the Norwegian coast, from England or from Denmark is in practice equal to zero.

Corresponding observations are made in Brazil, where the strongest winds and the 100-year wave statistically will come from a northerly direction. At the installation of a production vessel in Brazil, one takes into account, to an increasing extent, the dominating weather directions. As the weather conditions outside Brazil are not as rough as in the North Atlantic, one will therefore be able to anchor production ships with a fixed orientation in favourable directions to avoid the complex turrets. Thus, one can pull the many production risers directly onto the production ship. This is especially desirable for the many oilfields in Brazil with a high pressure, wax-containing oil and with a high content of $CO_2$.

In addition, production ships that must be turned with the weather prevent good solutions for combined operations with drilling and production because these simultaneous operations will require that a vessel must be locked in one direction for the time periods that these operations are carried out.

Simultaneous operations of drilling and production are therefore only known today with semisubs that are anchored with several anchorage points, for example, on the "Visund" and "Njord" fields in the North Sea. However, semisubs for production that are formed according to known methods have a disadvantage in that they do not have an oil storage capability. This means that all the produced oil must be exported via a pipeline. This can be costly if the oilfield lies in distant waters a long way from other installations that can receive the oil.

A suggestion for anchoring a ship with a turret has also been described in a patent document wherein drilling is to be performed outside the turret, for example, from one end of the ship. Because the ship must be able to turn with the weather, one will be dependent on the ship being held accurately in its position when the drilling operations or the well intervention operations take place. This becomes more problematic if the well is placed unfavourably with respect to the strongest ocean environmental forces. If one finds oneself in an exposed area it will be difficult to carry out these well operations with the regularity one would wish.

Norwegian patent No. 313.794 describes a production vessel that combines drilling and production on a vessel that can turn +/−90°. However, this solution has limitations because the drilling takes place through the turret, something which makes the pulling in of production pipes difficult.

In this context, reference is also made to the U.S. Pat. Nos. 3,771,481 and 4,646,672.

OBJECTS OF THE PRESENT INVENTION

A main purpose of the invention is to provide a float structure comprised of several columns that is formed as a column-stabilising structure (semi-submersible unit, or semisub for short) and where at least one of the columns can be used for the storage of oil.

It is another object of the invention to provide a float structure in the form of a column-stabilising structure with several columns, where at least one of the columns is formed to comprise a store for oil, and possibly other fluids, and which is directly anchored by anchoring lines without the need to be turned with the weather, even in the most exposed environments.

It is another object of the invention to provide a float structure for storing oil that shall be able to respond to the movements from waves in the form of rolling, pitching and heaving movements just as well as traditional and known semisubs while anchored with several anchoring points.

It is another object of the invention to be able to provide a column-stabilising structure for use at sea that shows improved damage stability relative to known semisubs, where damage to, or loss of, a support column shall have limited consequences and which can be corrected and be repaired.

It is another object of the invention to provide a float structure, from a point of view of movement-response, that shall be able to produce oil with the same regularity as ordinary production vessels without the float structure having to turn with the weather.

It is another object of the invention that the float structure shall be able to be anchored in most known ocean areas.

It is another object of the invention to provide a float structure that can carry out combined drilling and production operations with a high regularity and simultaneous oil storage and oil loading while the float is anchored with several anchoring points.

It is another object of the invention to provide a float structure with a geometry which allows the float structure to be easily built in traditional ship docks and that can easily use equipment modules that can be placed side by side on a deck of the float structure.

DISCLOSURE OF THE PRESENT INVENTION

Briefly, the invention provides a float structure comprised of a bottom structure for providing buoyancy to the float structure, an upper equipment deck which is to be positioned above the surface of the water in which the float is arranged to operate and a plurality of support columns connecting the bottom structure to the equipment deck.

In accordance with the invention at least one of the support columns is disposed in a middle section of the bottom structure to provide for the storage of liquid and the remaining support columns are positioned in the outer sections of the bottom structure.

In addition, a plurality of active ballast tanks are disposed in the middle section of the bottom structure adjacent the support column that is to store liquid and a plurality of secondary ballast tanks are disposed in an outer part of the bottom structure.

The float structure functions as a separate storage float for the temporary storing of oil at sea, or can be structured into a oil and gas drilling and/or production installation at sea.

The float structure may be anchored, in particular, for production and storage of liquids, such as hydrocarbons, like oil and which, at the same time, has the possibility to store and take in the fluid/oil without the structure turning with the weather, even in exposed environments.

The float structure is intended to be used at most water depths, for example from about 50 meters depth to about 3000 meters depth.

Preferably, the bottom section of liquid storage column of the float structure constitutes an integrated central section the bottom structure of the float.

Preferably, the liquid storage column is divided into a plurality of oil storage tanks.

Preferably, the active first ballast tanks form a system that is positioned adjacent to the oil storage column and is disposed in a square ring shaped to enclose the lower parts of the oil storage column.

Preferably, the active first ballast tank system is divided into two or more smaller tanks of a ring shape for water ballasting of the float structure by the addition of or removal of ballast water.

Preferably, and considered outwards from the central area (X) of the bottom structure, the tanks are arranged in the following order: the central oil column tank, the first (active) ballasting tanks and the second (passive) ballast tanks.

Preferably, the active ballast tanks enclose the oil storage column over the total height of the column.

Preferably, at least one of the active ballast tanks extends underneath the oil storage column.

Preferably, a box construction is connected to the underside of the bottom structure and extends outside of the outline of the main bottom structure.

Preferably, the bottom structure is formed with a plurality of vertical openings (moon pools) in the area between the support columns and the oil storage column.

Preferably, the ratio between the waterline areas of the oil storage column and the individual support columns 4 is roughly 20/1 and up to 40/1.

Preferably, the bottom structure of the float structure has a preferred length/width ratio of between 2/1 and 3/1.

Preferably, the support columns border the outer ballast tanks that are not made to store hydrocarbons in the form of oil or gas that is produced onboard the float structure.

Preferably, the float structure provides a separate storage float for temporary storing of oil at sea, or can be structured into a oil and gas drilling and/or production installation at sea.

For operation at sea, the total volume and pumping capacity of the active ballasting tanks are such as to be sufficient to ensure the wanted draught of the float structure with varying oil amounts in the oil storage tanks.

Preferably, the outer ballast tanks are operationally independent of the amount of oil stored onboard in the storage column.

It is preferred that oil be stored in the oil storage column, but the float structure is equally applicable even if the oil storage column is only used to store seawater to ensure the necessary stability.

Advantages of the Invention

An oil storage column according to the invention will have a considerably larger waterline area than the other support columns. In the main, the support columns will have a strength and a buoyancy function corresponding to those of a traditional semisub and these support columns will have a much more limited waterline area than the oil storage column.

The float structure according to the invention shall, in a safe and predictable way, be able to be operated with a draught that lies inside the desired maximum and minimum values that means that the ballast capacity of the float must be able to compensate for, according to known methods, the weight of the varying amounts of oil which are being stored onboard at any given time. Draught is a term defined to the maximum depth of the vessel below the water level.

The oil storage column and associated oil storage space will, according to the invention, be placed in the middle section of the float structure. Correspondingly, most of the ballast water volume that is used to compensate for varying amounts of oil that are in the oil storage at any given time, will, according to the invention, be arranged inside the active ballast tanks that are placed as much to the middle of the float structure as possible.

The support columns will in the same way be placed in the outer part of the float to give support to the deck with equipment.

With the expressions "middle of the float", or "middle section of the float", is meant in this context the middle area of a projection of the float structure in the horizontal plane, something which in most cases is very close to the vertical axis of the light-ship point of gravity of the float. With the expression "outer part of the float" is meant in a similar way a placing of the support columns in the peripheral part of the same projection, so that the support columns can support the deck according to known methods from traditional semisubs, and function as buoyancy bodies for the float at an given distance from the middle of the float.

The placing of the oil storage column towards the middle of the float is, according to the invention, important because a semisub with an oil storage will have a smaller waterline area in total than a corresponding production ship and the consequences of failures during filling and emptying of the oil tanks and the ballast tanks will appear much quicker than on a production ship. By placing the oil storage column and the compensating, active ballast tanks towards the middle of the float, the chance for uneven ballasting and listing of the float is considerably reduced.

For the same reason it is important that the float structure, according to the invention, has a sufficient waterline area, in particular for the oil storage column, which gives satisfactory operational time margins during filling and unloading of the oil tanks and the ballast tanks.

In that a combined waterline area of the oil storage column and the support columns is greater than for traditional semisubs, the consequences of possible mistakes during filling and unloading of the oil tanks and the ballast tanks will be easier to prevent compared to using a traditional semisub structure for oil storage. This is due to the consequences of any mistakes during operation appearing slower and within a time frame so that one has more time to correct such mistakes, and possibly stop the operations in time.

One of the advantages of the invention where one combines a large oil storage column towards the middle and several, smaller support columns towards the edges, will furthermore be a much improved damage stability compared to traditional semisubs. A traditional semisub built according to known methods will normally not be able to withstand a collision to one of the outer columns so that the column is filled with water. In many cases, this will lead to the semisub tilting so much that it will be destroyed.

However, it is possible to form a column-stabilised float structure to withstand a total loss of one support column because it is possible to form the oil storage column and the other support columns with a residual buoyancy so that they can give sufficient stability to avoid a total loss of the unit in such accidents. In addition, the oil storage column will be able to be formed with double hulls against the sea to further increase safety.

Traditional semisubs are shaped to give excellent mobility in heavy seas, in particular, for movements such as heaving, rolling and pitching. Calculations and tank tests show that a float structure according to the invention will have approximately the same movement characteristics as semisubs in spite of the float structure according to the invention having a considerably larger waterline area, mainly due to a large oil storage column with a large waterline area. The excellent movements are due to the float according to the invention being formed with a large horizontal bottom structure that gives additional dampening properties which is due to additional mass effects and non-linear frictional forces. In addition, the same type of cancelling effects is achieved between the columns and the bottom structure which is also well known in the design of the standard semisubs.

These movement-dampening effects are reinforced in that the bottom of the bottom structure, and in most parts of its circumference, is formed with a horizontally outwardly extending box structure which, according to calculations and tank tests, gives a considerably additional dampening, in particular during rolling and pitching, but also in heaving. The additional dampening by this box structure is also mainly due to non-linear dampening and functions best when this box structure is placed at the greatest possible depth, where the speed of the wave particles is the lowest.

By placing an essential part of the buoyancy volume of the float and the waterline area in the middle of the float, one is free to form the geometry of the other parts of the float. From this, a huge advantage arises in that the float structure can be formed so that it can be effectively built in international building dockyards. Thus, the float structure may be structured with a breadth of up to 50-65 meters for the float structure; at the same time as one has more freedom with respect to the length of the float structure. Most large dry docks in the world will fit a float structure of a length up towards 200 meters.

The bottom structure can be formed to provide an additional storage for oil beyond what is formed in the oil storage column. Then it is an advantage that this part of the oil storage is also placed towards the middle of the bottom structure so that it is possible to integrate with the oil storage that is in the oil storage column so that the effect of any mistakes during operation is reduced to a minimum. The volume of the bottom structure can be varied dependent on, among other things, the need for the size of the oil storage. A typical height of the bottom structure will be in a range of about 15 to about 40 meters, something that will provide a possible oil storage capacity from about 350 000 barrels to about 800 000 barrels on the float.

Associated active ballast tanks that shall compensate for varying oil storage filling should also be placed as near the middle of the float structure as possible to reduce the consequences of any operational mistakes.

The outer part in the horizontal plane of the float structure comprises the outer ballast tanks in the bottom structure and the support columns. These outer volumes should, according to the invention, be used to the largest extent possible as secondary ballast tanks and buoyancy volume, and which are operated almost independently of the active ballast tanks towards the middle of the float structure and thereby approximately independently of the loading and unloading operations for oil. The most advantageous is that these outer ballast tanks are not in use at all during operation of the float structure and when the amount of oil onboard varies, more or less as permanent ballast and buoyancy tanks. Thereby, these outer ballast tanks should have a reduced filling and pumping capacity to reduce the consequences of possible operational mistakes.

The bottom structure can be shaped in many ways dependent on the demand and method of transportation. If the bottom structure shall be partially dry during the towing, and it is to be towed a short distance to the installation location, one will be able to disregard resistance from the sea and transportation time, and thereby be able to use straight steel plates in the structure. If there is a large towing distance, for example, from a shipyard in Asia to Europe, it can be advantageous to form the bottom structure for the purpose of reducing the resistance to travelling in the sea, for example, with rounded sections according to known methods.

The float structure according to the invention will be formed with a deck whereupon living quarters, process modules, units for power generation and other equipment that is necessary for the operative function of the float can be placed. By being able to offer a larger deck area which is supported by several columns, one will be able to base the equipping of the deck on installation of modules, something which is more cost effective and gives a shorter time for the building and fitting of the float structure.

The float structure will be anchored with several anchoring points according to known principles, where the anchoring mode depends on depth of water, ocean environment, size and shape of the float. This will mean, for example, at a depth of about 1000 meters at the Haltenbanken, about 4-5 lines in each corner of the float structure. In deeper waters, it is considered advantageous to use known methods for tight anchoring lines in a synthetic material such as polyethylene, Kevlar, etc. In the placing of the anchoring lines, it will be operationally advantageous to take into consideration the dominant directions for the ocean environmental forces so that one, to some extent, considers an oblong, for example rectangular, shaping of the float structure.

In the same way, it is possible to pull risers into the float structure according to the known methods, either at the outside of the float structure or through dedicated openings (moon pools) in the bottom structure and the deck. Furthermore, calculations and tank tests have shown that moon pools in the bottom structure will be, in addition, advantageous for the movements of the float structure, in that the heaving movement in particular will be dampened further. This is primarily due to non-linear viscous effects, but the pressure equalisation above and below the float structure gives a positive contribution to this dampening.

Calculations have shown that the float structure according to the invention shows excellent movement characteristics even in exposed environments. The float structure will have sufficiently good movement characteristics so that it can be used in combination with risers of steel in deep waters (Steel Catenary Risers=SCR). Typical risers in steel shall have movements at the waterline that typically do not exceed an acceleration of 2.5 $m/s^2$ and shall in addition not have maximum simple amplitude that exceeds 10.2 meters vertically.

Another advantage with the float structure having good movement characteristics will be that the float structure can be anchored in shallow water and be connected via a bridge to a wellhead platform sitting on the sea bed. This is known from the Veslefrikk field in the North Sea where a conventional semisub is used. A float structure according to the invention will have equally good movement characteristics, but one will be able, in addition, to offer storage for the oil, something which is advantageous if one shall produce heavy oil or wax-containing oil so that this can be transferred directly to the float structure without having to go through long pipes on the ocean bed out to a remote production ship with a turret.

Furthermore, oil storage onboard with this type of solution is advantageous if the oil field is located far away from connection points for the transport pipes for oil.

In this description it is assumed that the float structure according to the invention is formed in steel, but other materials, such as concrete, can also be used.

DRAWINGS SHOWING THE PRESENT INVENTION

The device of the invention shall be explained in more detail in the following description with reference to the enclosed figures, in which.

EMBODIMENTS OF THE PRESENT INVENTION

Figure 1:
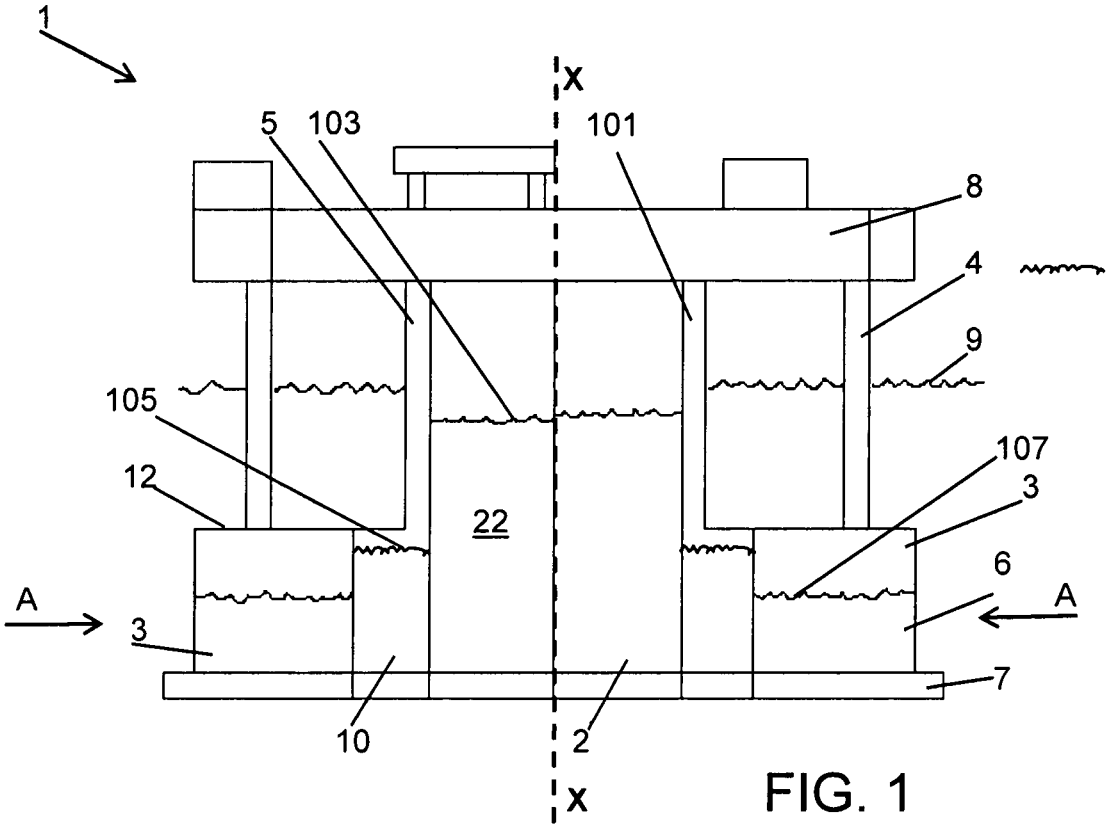
FIG. 1 shows a vertical section of a float structure according to the invention.
Figure 2:
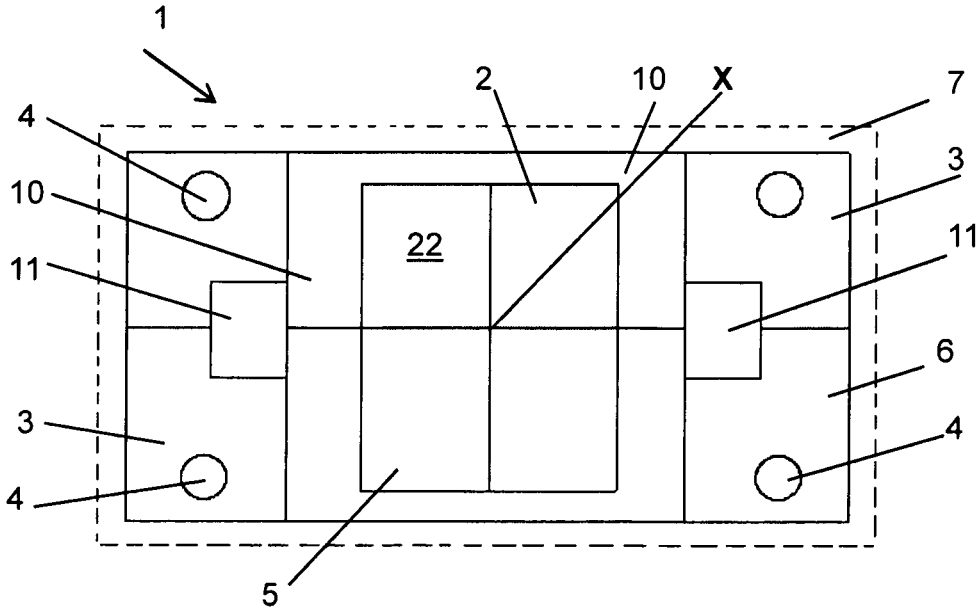
FIG. 2 shows a horizontal cross section through the bottom structure of the float structure along the lines A-A on FIG. 1 as used for storage of oil, ballast water or other liquid fluids in the bottom structure.

Reference is initially made to the FIGS. 1 and 2 where the float structure 1 is shown designed with a bottom structure 6 providing buoyancy to the float and an equipment deck 8. The central vertical axis X of the float is shown by X.

A plurality of support columns 4 connect the bottom structure 6 and the equipment deck 8 that is situated above the surface 9 of the water (sea level). One support column 4 may be positioned in each corner of the structure, for example.

Further, a box construction 7 runs continuously in the horizontal plane around and below the whole of the lower part of the bottom structure 6 and, in a plan view, extends outside of the outline of the main bottom structure 6, as shown in dashed lines on FIG. 2. The box construction 7 may be a hollow tank that contributes to the buoyancy of the float structure and adds stability and dampening properties. The box construction 7 is connected to the underside of the bottom structure 6.

An oil storage column 5 represents the middle part of the bottom structure 6 and extends above the top surface 12 of the bottom structure 6 to be connected to and to support the equipment deck 8. The storage column 5 may be divided in a number of separate storage tanks 2 for oil 22 forming a central unit positioned around the central vertical axis X of the float structure. Four storage tanks are shown in FIG. 2. The oil surface level at a current level of oil 22 inside the column tank 5 is shown by reference number 103 in FIG. 1.

Parts of the middle section of the bottom structure 6, and in a same level 12, also comprise an active ballast tank 10 positioned adjacent to the oil storage column tank 5. As shown in FIG. 2, the ballast tank 10 represent a square ring shaped tank system 10 enclosing or surrounding the lower part of the oil storage column 5. The tank 10 may also be divided in two or more smaller tanks of a ring shape. This ballast tank or tanks 10 are in active use for ballasting the float structure, by adding or removing ballast water. A possible ballast water filling level of is shown by reference number 105.

Outside of ballast tank system 10, the bottom structure 6 further comprises a plurality of secondary ballast tanks 3 placed in the outer part of the bottom structure 6 of the float structure 1. A possible ballast water filling level of is shown by reference number 107.

Considered outwards from the central area (X), the tanks are arranged in the following order: The central oil column, the first (active) ballasting tank 10 and the second (passive) ballast tank 3.

The active ballast tanks 10 can be formed to enclose the central oil storage column 5/2 over its total height, as shown by reference numeral 101 in FIG. 1.

It may be preferred to arrange the active ballast tanks 10 to extend underneath the oil storage tanks 2 also (i.e. on top of the box construction 7) so that these tanks 10 form a double bottom in the bottom structure 6 similar to known principles from tankers. Also, the lower box construction will function as an extra double bottom section, adding further to the operating safety the float structure 1.

The system of pipes, hoses and pumping units to conduct adding to and removing of oil and water ballasting liquids from the tanks 5, 10 and 3, are not shown in the enclosed drawings, or disclosed further.

The fluid volume, in the form of seawater, inside the active ballast tanks 10 is, similar to well known methods, primarily used to compensate for the draught of the float and the angle of floating (tilt) during the operations where one increases or reduces the degree of filling of the oil tanks 2 so that the float structure 1 is within the draught margins that are relevant for the float structure 1 at all times. Draught is a term defined to the maximum depth of the vessel below the water level 9 for this float.

By placing the active ballast tanks 10 towards the middle of the float structure 1, the consequences of possible mistakes in operation of the ballast system will result in less severe tilting of the float structure. The total waterline area (at 9) of all the columns must be sufficient so that one has sufficient time to correct negative consequences of any operational mistakes of these systems.

The ballast tanks 3 are used for the general tuning and adjusting of the draught of the float structure, largely operationally independently of the amount of oil which is stored in the column tank 5 at any given time.

For reasons of safety it will be an advantage that the volumes below the support columns 4, i.e. the tanks 3 on top of which the columns 4 rest, are free of fluid hydrocarbons, in that the support columns only border towards the tank system that are free of explosion risks, i.e. tanks that are proof ballast tanks or empty, buoyancy tanks free of explosive gases.

The ballast tanks 10 will be able to function as a double skin protection against the environment sea, set up according to the same known principles as on a tanker, something which will reduce the consequences of any collisions with other vessels for example, or possible leaks from the tank 5.

The active ballast tanks 10 must have a sufficient volume to compensate for the amount of fluid, preferably oil, which is present in the oil storage tanks 2 at any given time so that the float structure 1 has a draught at any given time that lies within the relevant limits. The span of the draught limit can be several meters, for example, 7 meters, but it is important that the deck 8 has enough free height at any given time so that incoming waves do not reach the deck 8.

FIGS. 1-4 show an oil storage column 5, but the oil tanks 2 can also be arranged in several individual oil storage columns 5. The invention assumes in this case that these oil storage columns 5 are situated towards the middle of the float structure 1 and have a satisfactory combined waterline area that gives the necessary reaction time to prevent negative consequences of possible operational mistakes for the oil storage and the ballast systems such as when the platform operator initiates that large amounts of water is added or removed from the ballast tanks in a short period of time.

If the float structure 1 is to be installed in especially exposed areas, it is particularly especially favourably for its strength to have a length/width ratio for the bottom structure 6 that does not exceed 3/1. An example of a favourable geometry for the bottom structure 6 will be, for example, about 50 meters width and 150 meters length, something which will give a L/W ratio of 3.0 and a total area of 7500 $m^2$. However, it is possible to vary these dimensions, but it is an advantage that the float structure 1 is well adapted to building at a shipyard, at the same time as the L/W ratio does not get too large to avoid essential deflections of the structure during periods of bad weather.

The oil storage tank 5 will, in this example, have a favourable size with a waterline area of 2500 $m^2$ based on an approximately square outer shape of 50×50 meters. With the four support columns 4 placed in each corner of the outer part of this float 1, each support column can, for example, have a waterline area 10×10 meters=100 $m^2$. This will give a total waterline area of 2900 $m^2$ (2500+4×100).

With an assumed height of the bottom structure of 20 meters, and overall draught for the float structure of 40 meters and a deck weight of 12 000 tonnes, calculation for this example shows that a loss of one corner column 4, as a consequence of a collision, will result in a tilt of less than 10°, something which ensures that the float structure 1 can be towed ashore for repairs.

To improve the movements of the float structure 1 further, calculations have shown that this is achieved by arranging a box construction 7 that preferably runs continuously in the horizontal plane around the whole of the lower part of the bottom structure. The box construction 7 extends outwards from the bottom structure 6 and will be able to have an area in a vertical section of about 3×2 meters or 3×3 meters in a vertical section to give the desired dampening effects. The box structure will preferably have an approximately square vertical section, but calculations have shown that a triangular vertical section functions well for waves of shorter lengths. The movements of the float structure, in particular during heaving, will be reduced further if the bottom structure 6 is formed with a number of vertical openings 11 (moon pools) in the area between the columns 4, 5, as shown in FIG. 2. The size of these vertical openings 11 will typically be 100-200 $m^2$, dependent on the size of the bottom structure and to what extent this dampening is required. It is regarded to be an advantage that these vertical openings 11 are placed approximately symmetrically around the middle section of the bottom structure.

The present invention will give increased safety compared to traditional semisubs because the oil storage column 5 placed in the middle of the float structure will constitute a large part of the buoyancy and of the waterline area, where the float structure 1 is formed so that loss of one support column 4 due to, for example, a collision, will not have catastrophic consequences. A support column which is filled with fluid or is lost will according to the invention be able to constitute a very limited part of the waterline area and the buoyancy.

To improve the safety against loss of a corner column as a consequence of an explosion onboard, it will be an advantage that the support columns 4 borders against the outer ballast tanks 3, i.e. the tanks which are not made to store hydrocarbons in the form of oil or gas that is produced onboard the float structure 1.

The oil storage tank 5 will be able, in a typical form, to have a waterline area of 2500 $m^2$ based on an approximately square outer shape of 50×50 meters. With four support columns 4, one placed in each corner of the outer part of this float 1, and where each support column 4 has, for example, a shape of 10×10 meters=100 $m^2$ waterline area, then the total waterline area will be 2900 $m^2$ (2500+4×100). With a height of the bottom structure 6 of 20 meters and total draught for the float 1 of 40 meters, calculations show in this example that loss of one corner column 4 as a consequence of a collision, will lead to a tilt from the damage of less than 10°, something which makes it possible to tow the float structure ashore for repairs.

It is considered, an advantage that the ratio between the waterline areas for the oil storage column 5 and the individual support columns 4 is at least 20/1 in exposed environments. In milder environment seas, this ratio can be increased further, possibly up to 40/1 if this should be required. This large ratio between the waterline areas will contribute to ensuring safe loading and unloading operations for the oil stored onboard the float structure 1, and at the same time, ensures that the float structure 1 has adequate stability against damages exposed to one of the support columns 4.

A preferred form of the float structure 1 according to the invention will be one single large oil storage column 5 in combination with four support columns 4 one in each corner of the float structure 1.

In calmer waters the waterline area of the oil storage column 5 can be increased further than what is given in the example above, possibly up to 5-8000 $m^2$. At the same time, the float structure 1 can be given a more square or circular shape and the number of support columns 4 between the bottom structure 6 and the deck structure, can be increased, for example, to six or eight columns.

In addition, an increased number of support columns 4 will reduce the consequences further if an accident shall arise with a subsequent loss of one support column 4. In the case of a circular float structure, a number of support columns are placed at mutually constant intervals around the periphery at a sufficient distance from the float structure circular outer edge.

Figure 3:
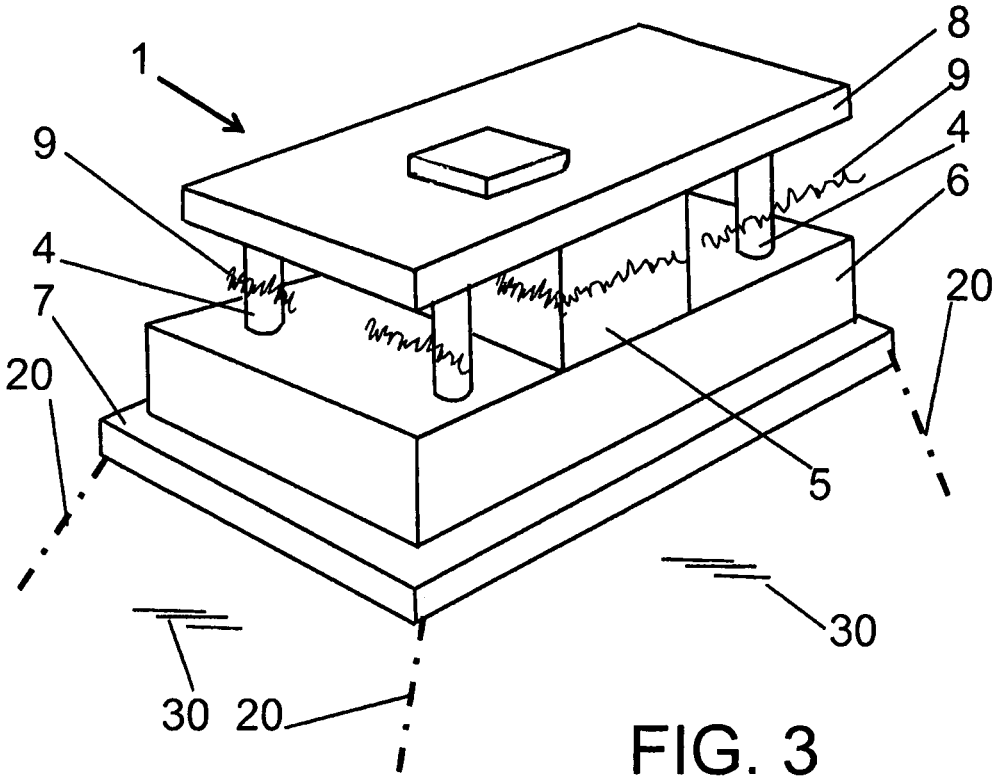
FIG. 3 shows a perspective outline of a float structure according to the invention with an oil storage column that in the horizontal plane is approximately square or rectangular and with a bottom structure which is also approximately rectangular.
Figure 4:
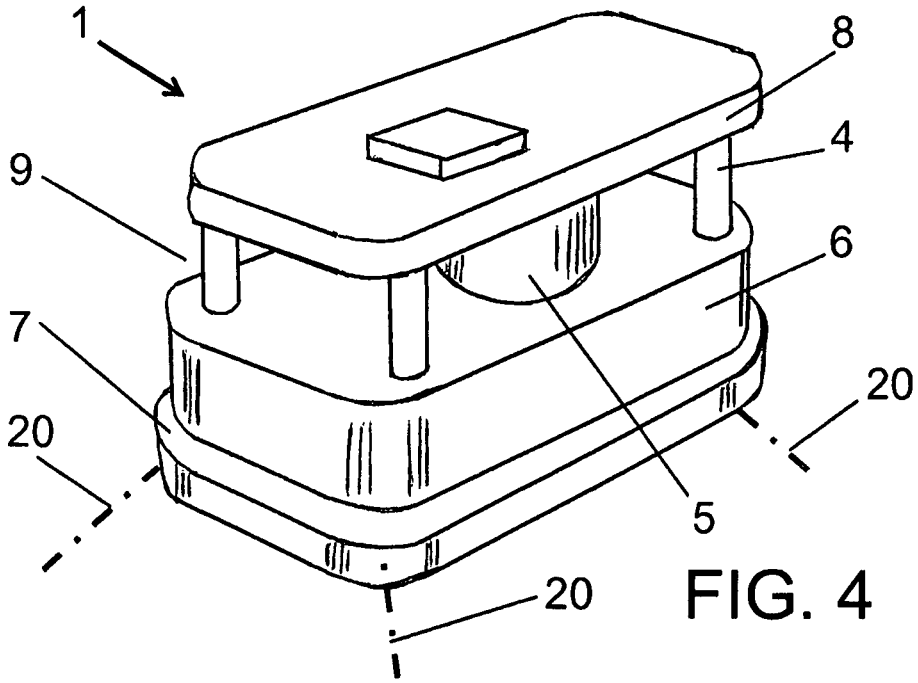
FIG. 4 shows a perspective outline of a float structure according to the invention with an oil storage column that in the horizontal plane is approximately circular and with a bottom structure which is approximately elliptic.

The columns 4, 5 of the float structure can have different dimensions and shapes. FIG. 3 shows the float structure 1 with an oil storage column 5 that is approximately square, while FIG. 4 shows a cylindrical version of the oil storage column, and with rounded corners. According to a preferred embodiment, the columns are vertical or approximately vertical, but it is also possible that a number of the columns 4, 5 are arranged at a different angle with respect to the horizontal plane than the vertical direction that is given on the drawing of the columns 4, 5. The columns 4, 5 can also have a conical shape (in vertical section) if this is appropriate.

The support columns 4, 5 can be combined according to known methods by a framework of shorter inclined of struts (not shown) that will make the whole structure more rigid.

According to a preferred mode of operation, the first set of ballasting tanks 10 positioned closest to the center of the float structure 1, are in active use for adding or draining of ballast water, and not the secondary ballasting tanks 3 that are positioned outside of the tanks at the center of the float structure 1. This is due to the fact that adding (or removing) ballast water, for example several thousands of cubic meters of water per hour, into the active tanks 10, results in less heave moment influence tilting the float structure 1, than adding said water into the secondary tanks 3. In order to maintain the float at a constant level position at the sea surface 9, when for example one ton of oil is loaded and pumped into the center tanks 5/2, a similar weight amount of water is removed from the ballasting tanks 10.

The consequences of error in adding water to or removing water from the ballast tanks 10 will be less in this manner.

Storage of oil or other fluids in the oil storage column 5 is referred to above. The invention is equally applicable if the oil storage column 5 is filled with seawater instead.

The invention also assumes that the float structure 1 is anchored to the bottom 30 of the sea according to known methods as shown by anchor lines 20 (illustrated in FIG. 3), where the anchor lines can comprise chains, wires or hawsers of light artificial fibres of, for example, polyester or polyethylene.

The float structure is particularly advantageous in strongly weather-exposed areas, for example, on the Haltenbanken outside the Norway coastline, where the 100-year wave from known sectors is estimated to be up to about 40 meters. The float shall be formed in the same way to be anchored in areas with extreme waves of above 35 meters, where the waves may arrive from several different directions, such as during a hurricane in the Gulf of Mexico.

The oil that is produced and stored in the tank 5 onboard in the float structure 1 can be transferred to tankers according to known methods by means of piping and pump loading systems (not shown).

The float structure 1 according to the invention can preferably be built in steel or concrete or a combination of these materials.

What is claimed is:

1. A float structure comprising a bottom structure for providing buoyancy to the float structure;

an upper equipment deck;

a plurality of support columns each connecting said bottom structure to said equipment deck, at least one of said support columns being disposed in a middle section of said bottom structure to provide for the storage of liquid therein and the remaining support columns of said plurality of support columns are positioned in the outer sections of said bottom structure;

a plurality of active ballast tanks disposed in said middle section of said bottom structure adjacent said one support column, said active ballast tanks being disposed in a ring enclosing at least a lower part of said one storage column for storing liquid; and a plurality of secondary ballast tanks disposed in an outer part of said bottom structure.

2. A float structure according to claim 1 characterised in that a bottom section of said one storage column for storing liquid constitutes an integrated central section of said bottom structure.

3. A float structure according to claim 1 characterised in that said one storage column for storing liquid is divided into a plurality of oil storage tanks.

4. A float structure according to claim 1 characterised in that said active ballast tanks are disposed in a square ring shaped to enclose at least a lower part of said one storage column for storing liquid.

5. A float structure comprising a bottom structure for proving buoyancy to the float structure;

an upper equipment deck;

a plurality of support columns each connecting said bottom structure to said equipment deck, at least one of said support columns being disposed in a middle section of said bottom structure to provide for the storage of liquid therein and the remaining support columns of said plurality of support columns are positioned in the outer sections of said bottom structure;

a plurality of active ballast tanks disposed in said middle section of said bottom structure adjacent said one support column, said active ballast tanks being divided into at least two smaller tanks of a ring shape for receiving water for ballasting the float structure; and a plurality of secondary ballast tanks disposed in an outer part of said bottom structure.

6. A float structure according to claim 1 characterised in that said active ballast tanks enclose said one storage column for storing liquid over the total height of said one storage column.

7. A float structure according to claim 1 characterised in that at least one of said active ballast tanks extends underneath said one storage column for storing liquid.

8. A float structure according to claim 1 further comprising a box construction connected to the underside of said bottom structure and extending outside of the outline of said bottom structure.

9. A float structure according to claim 1 characterised in that said bottom structure has a plurality of vertical openings disposed between said one storage column for storing liquid and said remaining support columns.

10. A float structure according to claim 1 characterised in that the ratio between the waterline areas of said one storage column for storing liquid and said remaining support columns is between 20/1 and to 40/1.

11. A float structure according to claim 1 characterised in that said bottom structure has a length/width ratio of between 2/1 and 3/1.

12. A float structure according to claim 1 characterised in that said remaining support columns border said secondary ballast tanks.

13. A float structure comprising a bottom structure for providing buoyancy to the float structure;

a box construction connected to an underside of said bottom structure and extending outside of the outline of said bottom structure, an upper equipment deck;

a plurality of support columns each connecting said bottom structure to said equipment deck, at least one of said support columns being disposed in a middle section of said bottom structure to provide for the storage of liquid therein;

a plurality of active ballast tanks disposed about said one support column for selectively receiving ballast water, said active ballast tanks being disposed in a ring enclosing at least a lower part of said one storage column for storing liquid; and a plurality of secondary ballast tanks disposed in an outer part of said bottom structure for selectively receiving ballast water.

14. A float structure according to claim 13 wherein said one support column is disposed on a vertical central axis of said bottom structure.

* * * * *